US007520636B2

(12) United States Patent
Van Der Poel

(10) Patent No.: US 7,520,636 B2
(45) Date of Patent: Apr. 21, 2009

(54) LUMINAIRE COMPRISING LEDS

(75) Inventor: Lucas Leo Desiree Van Der Poel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/092,716

(22) PCT Filed: Nov. 7, 2006

(86) PCT No.: PCT/IB2006/054140

§ 371 (c)(1),
(2), (4) Date: May 6, 2008

(87) PCT Pub. No.: WO2007/054889

PCT Pub. Date: May 18, 2007

(65) Prior Publication Data

US 2008/0278943 A1 Nov. 13, 2008

(30) Foreign Application Priority Data

Nov. 11, 2005 (EP) ..... 05110631

(51) Int. Cl.
*F21V 7/06* (2006.01)

(52) U.S. Cl. ..... 362/290; 362/298; 362/342

(58) Field of Classification Search ..... 362/228, 362/229, 290, 342, 800, 235, 298, 404, 249, 362/252
See application file for complete search history.

(56) References Cited

U.S. PATENT DOCUMENTS

| | | | | |
|---|---|---|---|---|
| 4,680,678 | A * | 7/1987 | Iwaki | 362/545 |
| 5,390,092 | A * | 2/1995 | Lin | 362/235 |
| 6,739,734 | B1 | 5/2004 | Hulgan | |
| 6,840,652 | B1 * | 1/2005 | Hymer | 362/235 |
| 7,246,921 | B2 * | 7/2007 | Jacobson et al. | 362/294 |
| 2002/0136025 | A1 | 9/2002 | Zhang | |
| 2004/0114371 | A1 | 6/2004 | Lea et al. | |
| 2005/0001537 | A1 | 1/2005 | West et al. | |

FOREIGN PATENT DOCUMENTS

| | | | |
|---|---|---|---|
| DE | 20313899 | UI | 1/2004 |
| DE | 10314257 | A1 | 10/2004 |
| GB | 2301176 | A | 11/1996 |
| JP | 2003092006 | A | 3/2003 |

* cited by examiner

*Primary Examiner*—Thomas M Sember

(57) ABSTRACT

This invention relates to a luminaire (106), which has a housing (103) with an opening (111) at a light output side, a reflector (105) mounted in the housing, and facing the light output side, a louver (107) mounted at the opening of the housing, and LEDs (109) mounted in the louver, such that the emitted LED light exits the luminaire only after reflection against the reflector, thereby providing indirect light output.

7 Claims, 3 Drawing Sheets

LUMINAIRE COMPRISING LEDS

FIELD OF THE INVENTION

The present invention relates to a luminaire comprising a housing having an opening at a light output side, a reflector mounted within the housing and facing the light output side and a plurality of LEDs as light sources using the reflector for providing indirect light output.

BACKGROUND OF THE INVENTION

A prior art luminaire of the above-mentioned type is disclosed in the German Patent Application publication No. DE 103 14 257 A1. The German prior art Luminaire has a reflector having a center longitudinal opening wherein a longitudinally co-extending light guide is arranged. Behind the light guide an array, and more particularly a row, of LEDs is arranged along the length of the light guide. The light emitted from the LEDs pass through the light guide. A part of the LED light is deflected by the light guide towards the surface of the reflector, and is reflected by the reflector towards a light output side of the luminaire, and the rest of the LED light is spread by the light guide towards the light output side. Thus a viewer looking at the luminaire sees a combination of LED light passing directly through the light guide, and LED light passing through the light guide and being reflected by the reflector.

The prior art luminaire has several disadvantages, among others the fixed placement of the LEDs, restricting the freedom in designing the luminaire, and the complex light guide.

SUMMARY OF THE INVENTION

It is an object of the present invention to provide a luminaire that alleviates the above-mentioned drawbacks of the prior art luminaire.

This object is achieved by a luminaire according to the present invention as defined in claim 1.

The invention is based on an insight that a primary property of the luminaire is indirect optics, which is obtained by screening off the LEDs from direct view for the observer.

In accordance with an aspect of the present invention, there is provided a luminaire comprising a housing having an opening at a light output side; a reflector mounted within the housing and facing the light output side; and a louver arranged at the opening. The louver is spaced from the reflector, and has a geometric shape, which opens towards the reflector. Further, the luminaire has a plurality of LEDs, which are arranged in the louver and which emit light onto the reflector. The light is reflected at the reflector and constitutes a light output of the luminaire. The louver prevents direct light emission from the LEDs towards the opening of the housing, and prevents glare.

By using the louver as a support for the LEDs it is possible to freely choose the placement of the LEDs, and thereby the shape of the reflector as well, for obtaining different light distribution as desired.

In an embodiment of the luminaire according to the present invention, as defined in claim 2, the LEDs are arranged in an array.

In an embodiment of the luminaire according to this invention, as defined in claim 4 the LEDs are arranged in a V-shaped louver, facilitating the mounting of the LEDs and providing a good screening effect.

In an embodiment of the luminaire according to this invention, as defined in claim 5, LEDs are arranged at the center of the luminaire, providing a good light distribution. LEDs can be located elsewhere as well contributing to the amount of light emitted and/or to the distribution of light.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1A:
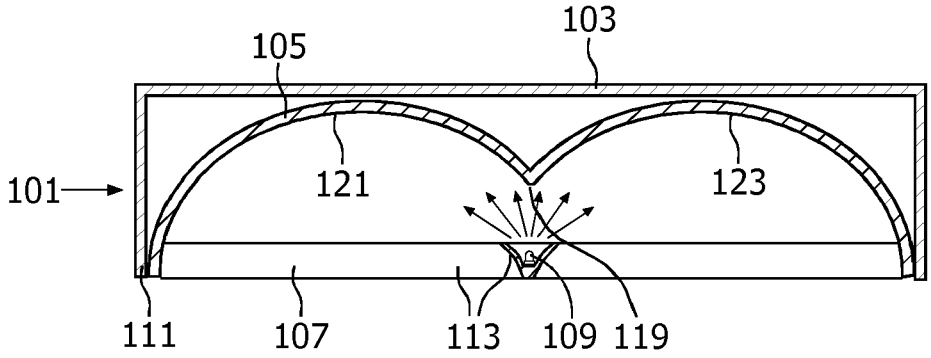
FIG. 1*a* is a cross-sectional view of an embodiment of a luminaire according to the present invention.
Figure 1B:
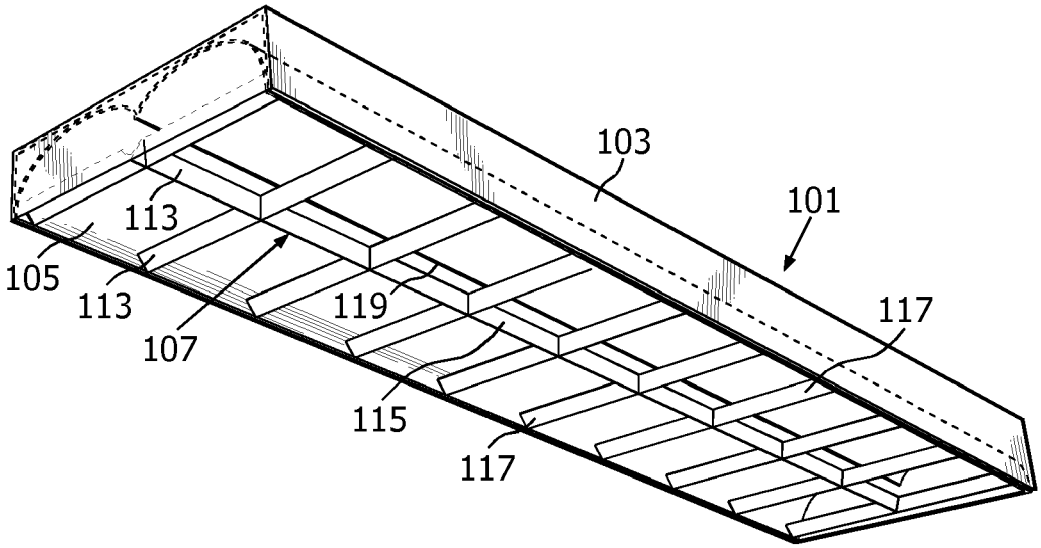
FIG. 1*b* is a perspective view from below of the luminaire of FIG. 1*a;*
Figure 1C:
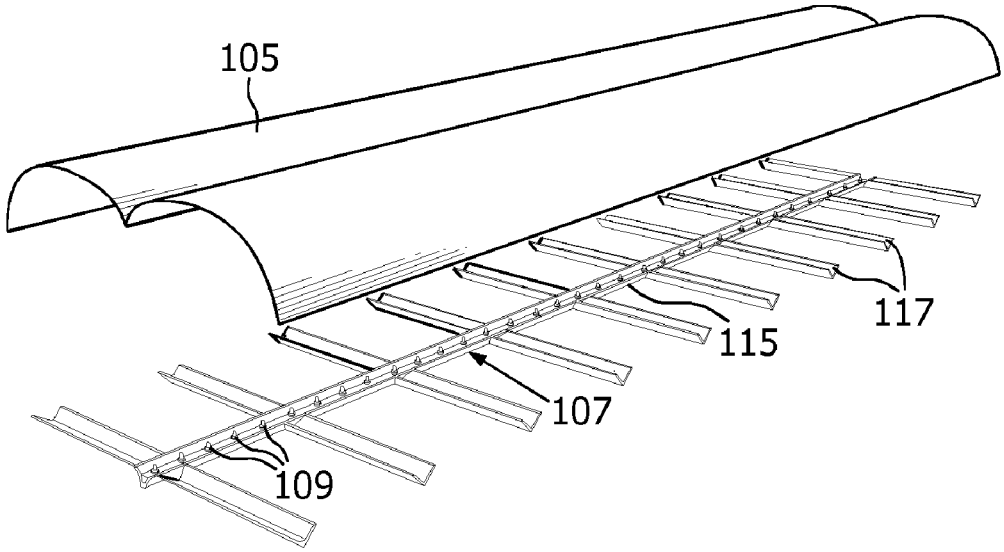
FIG. 1*c* is an exploded view of parts of the luminaire of FIG. 1*a;*

A first embodiment of a luminaire 101 according to the present invention comprises a housing 103, a reflector 105, a louver 107, and a plurality of Light Emitting Diodes (LEDs) 109. The housing 103 is box shaped and has a bottom opening 111, the bottom constituting a light output side of the housing 103. The reflector 105 is mounted within the housing 103, the reflecting surface facing downwards towards the opening 111. The louver 107 is engaged with side edge portions of the housing 103 at the opening 111. The louver 107 has several elongated louver portions 113 forming a grid. The grid consists of a longitudinal center louver portion 115, extending along the length of the housing 103 at the center of the opening 111, and a plurality of branch louver portions 117 extending perpendicular to the center louver portion 115, and extending between the long sides of the housing 103. The louver portions 113 are substantially V-shaped in cross-section, and more particularly the two walls of each louver portion 113 diverge upwards and are slightly curved. The louver portions 113 thus open towards the reflector 105.

The LEDs 109 are arranged in an array, and more particularly in a row, along the center louver portion 115. The reflector 105 is a double parabolic reflector, being interconnected along a boundary 119 between the inner long side edges of the two reflector parabolic halves 121, 123. Thus, the boundary 119 extends above and in parallel with the center louver portion 115.

When the LEDs 109 are powered they emit light towards the reflector 105. The emitted LED light is spread over both parabolic halves 121, 123. The emitted LED light is then reflected by the reflector towards and out of the opening 111 of the housing 101. Since the LEDs 109 are recessed in the louver portion 115 a person looking up into the luminaire 101 does not see direct LED light, but only indirect LED light reaching the person after reflection against the reflector 103.

Figure 2:
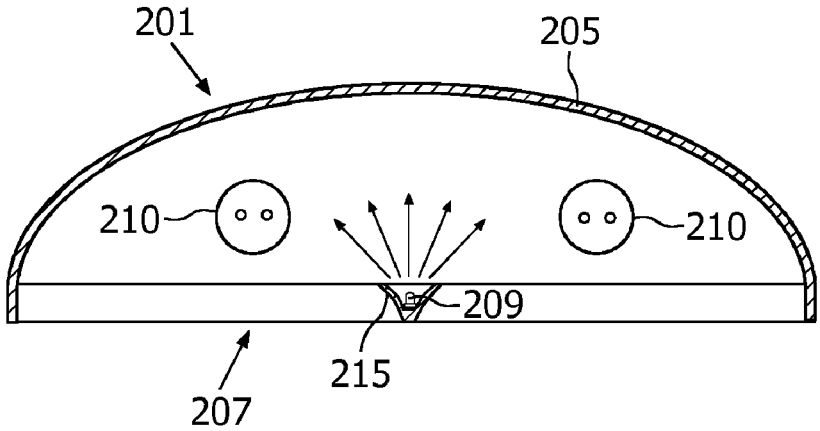
FIG. 2 is a cross-sectional view of another embodiment of a luminaire according to this invention.

Referring now to FIG. 2, a second embodiment of a luminaire according to this invention comprises a single parabolic elongated reflector 205, a grid shaped louver 207, a plurality of LEDs 209 arranged in a row along a center louver portion 215, similar to the first embodiment. Further the luminaire 201 comprises a second light source, which is comprised of two elongated fluorescent lamps, i.e. tubes, 210 extending in parallel with and obliquely above the LED row. In this embodiment the housing is omitted, or the reflector 205 constitutes or is integral with the housing.

In this second embodiment the LEDs 209 are combined with the lamps 210 in order to enable tuning of the light output. For example, the LEDs 209 can be used for adding colored light to the light of the second light source 210, which commonly is emitting white light. In this way the white light can be made more cool or warm or pastel colors can be realized. If the LEDs 209 are RGB LEDs arbitrary colors can be added. By making both light sources, i.e. the LEDs 209 and the lamps 210, individually dimmable a color balancing is performable. Then, for example, the saturated light emitted from the LEDs 209 can be made more pastel by adding white light emitted from the second light source 210.

Alternatively, the LEDs 209 can provide a decorative color effect in the luminaire, when the second light source 210 is dimmed or switched off.

Figure 3A:
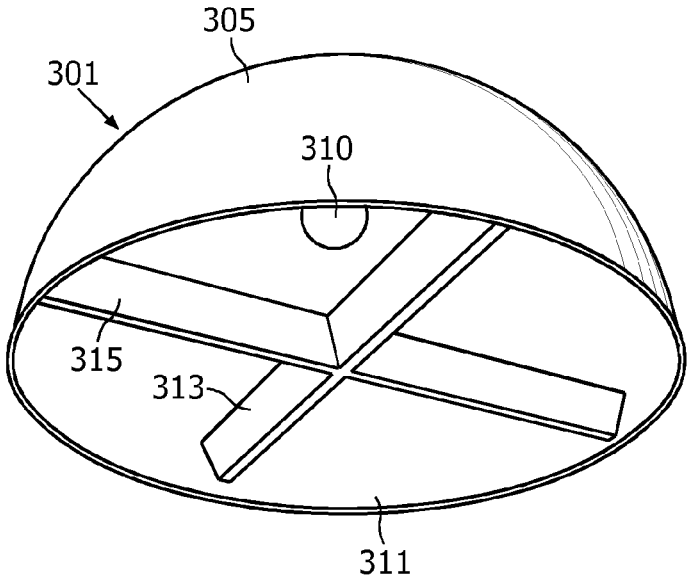
FIG. 3*a* is a perspective view from below of another embodiment of a luminaire according to this invention.
Figure 3B:
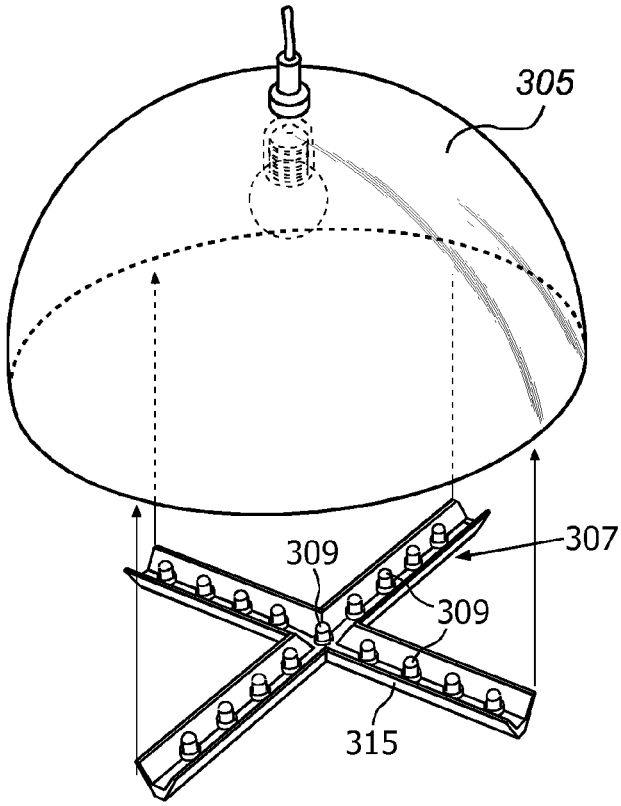
FIG. 3*b* is an exploded view of the luminaire of FIG. 3*a*.

Referring now to FIGS. 3*a* and 3*b*, a third embodiment of a luminaire according to this invention comprises a dome shaped reflector 305, a louver 307 shaped like a plus sign, and mounted at the opening 311 of the reflector, and a center lamp 310. LEDs 309 are arranged in arrays along both the perpendicular portions 313, 315 of the louver 307, and they emit light upwards towards the reflector 305, which reflects the light out of the opening 311 of the dome 305. It is understood that at least the first embodiment as well could have LEDs in the whole louver, and that embodiments having LEDs in arbitrary louver portions are also possible. However, in elongated luminaires it is preferable to provide at least the central louver portion with LEDs.

In addition to the above-mentioned, by adding a battery pack in the luminaire and an emergency switch connection the battery pack to the LEDs, the LEDs of the luminaire can be used for emergency lighting. Thus, when the ordinary power is disrupted, the emergency switch connects the battery pack to the LEDs.

Above, embodiments of the luminaire according to the present invention have been described. These should be seen as merely non-limiting examples. As understood by a skilled person, many modifications and alternative embodiments are possible within the scope of the invention.

For example the louvers can be U-shaped or W-shaped, or have any other shape providing a recess where the LEDs are mountable hidden from direct viewing by a viewer.

Thus, as explained by means of the embodiments above, a luminaire has an open bottom housing, a reflector mounted in the housing, a louver mounted at the opening of the housing, and LEDs mounted in the louver, such that the emitted LED light exits the luminaire only after reflection against the reflector, thereby providing indirect light output.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A luminaire comprising a housing having an opening at a light output side; a reflector mounted within the housing and facing the light output side; a louver arranged at the opening of the housing, and has a geometric shape opening towards the reflector; and a plurality of LEDs arranged in the louver and emitting light onto the reflector, which light is reflected at the reflector and constitutes a light output of the luminaire, wherein the louver prevents direct light emission from the LEDs towards the opening of the housing, and prevents glare.

2. A luminaire according to claim 1, wherein the louver comprises an elongated louver portion wherein the LEDs are arranged along a length of said elongated louver portion.

3. A luminaire according to claim 2, wherein said reflector is elongated and wherein said elongated louver portion extends along the length of the reflector.

4. A luminaire according to claim 2, wherein said elongated louver portion has a substantially V-shaped cross-section.

5. A luminaire according to claim 1, wherein the reflector is double parabolic, and wherein at least some of the LEDs extend along a center boundary between two parabolic parts of the double parabolic reflector.

6. A luminaire according to claim 1, further comprising a fluorescent lamp.

7. A luminaire according to claim 1, wherein the louver is grid shaped.

* * * * *